US006610365B2

(12) United States Patent
Baranauskas

(10) Patent No.: US 6,610,365 B2
(45) Date of Patent: Aug. 26, 2003

(54) METHODS OF PRODUCING CONDUCTOR LAYERS ON DIELECTRIC SURFACES

(75) Inventor: Mykolas Baranauskas, Vilnius (LT)

(73) Assignee: Shipley Company, L.L.C., Marlborough, MA (US)

( * ) Notice: Subject to any disclaimer, the term of this patent is extended or adjusted under 35 U.S.C. 154(b) by 0 days.

(21) Appl. No.: 09/910,448

(22) Filed: Jul. 20, 2001

(65) Prior Publication Data

US 2002/0139679 A1 Oct. 3, 2002

(30) Foreign Application Priority Data

Jul. 20, 2000 (LT) ..... 2000-074

(51) Int. Cl.[7] ..... B05D 3/04
(52) U.S. Cl. ..... 427/306; 427/304; 427/305

(58) Field of Search ..... 205/159, 164, 205/166; 427/304, 305, 306

(56) References Cited

U.S. PATENT DOCUMENTS 3,620,834 A * 11/1971 Duffy ..... 117/213

* cited by examiner

*Primary Examiner*—Edna Wong
(74) *Attorney, Agent, or Firm*—John J. Piskorski

(57) ABSTRACT

A method for producing conductor coating on dielectric surface may be used in many areas of industry for preparation of dielectric surfaces for selective electroplating. Using this method, conductor coatings are obtained when dielectric items are etched in acidic solutions containing oxidising agents, then treated in trivalent bismuth compound solution and additionally treated in sulphide solution.

18 Claims, No Drawings

METHODS OF PRODUCING CONDUCTOR LAYERS ON DIELECTRIC SURFACES

BACKGROUND OF THE INVENTION

1. Field of the Invention.

The present invention pertains to modification of qualities of a dielectric surface, in particular to render a dielectric surface to be an electric conductor. The invention may be used e.g. in various areas of industry for the preparation of dielectric surfaces of electroplating, especially for nickel-plating. Dielectric items which are metal-coated by processes of the invention may be used e.g. where a decorative or protective function is required, in manufacturing press-forms using the galvanoplastic method, or for assemblies for shielding electromagnetic emission.

2. Background.

One existing certain method of producing conductor surfaces is known (USSR patent No 980858, B 05 D 5/12, 1982), in which the dielectric surface is treated by amine-salt solution of copper, then immersed in water, then in sulphide solution and then rinsed with water.

Using this method, a quality conductor surface can be obtained by repeating the operation sequence described in the USSR patent at least three times. This increases the duration of the entire process, increases the consumption of water and chemicals and makes the use of automated production lines more difficult.

In addition, another certain existing process for producing conductor surfaces of cupric sulphide is known (USSR patent No 1762454, H 05 K 3/42, 3/18, 1991), in which dielectric items are immersed into solution of univalent cupric salt, then into a solution of 0.0025/0.025 of potassium persulphate, iodine or potassium nitrite solution, then rinsed with water and immersed into sulphide solution of an alkaline metal. This process is carried out at room temperature and each operation is repeated twice.

The shortcomings of the method described in USSR patent No 1762454 are the same as the shortcomings described in the preceding patent. In addition, through application of both existing methods, it is impossible to leave an isolated part of the item uncovered, i.e., it is impossible to achieve selective conductor coating.

See also the patent application of the Republic of Lithuania No 98–161, published in the official bulletin of Lithuanian State Patent Bureau (VPB) No 5 in 2000. That reported method also has notable shortcomiongs, including problematic use of a cobalt solution.

It would be desirable to have new methods to render a dielectric surface electrically conductive.

SUMMARY OF THE INVENTION

The present invention enables selective production of quality conductor metal sulphide coatings on a dielectric surface without the use of ammonia hydroxide or amine, and to make the process shorter.

The invention also enables producing conductor coatings with the use of stable ionic solutions.

More particularly, methods of the invention include treating a dielectric surface with a composition comprising bismuth and with sulfur (sulfide) treatment. Preferably, the dielectric substrate is treated with a solution that contains bismuth ions, particularly trivalent bismuth ions. The treated substrate is then preferably treated with a sulfide solution. A water rinse can be suitably employed between the treatment with bismuth composition and the sulfur treatment.

Prior to the treatment with a bismuth composition, a dielectric substrate is suitably etched. A variety of etchants may be employed. Generally preferred is an acidic aqueous solution that comprises e.g. $KIO_4$, or $K_2S_2O_8$ and $CrO_3$.

A variety of sulfur compositions also may be employed. An aqueous solution containing a sulfur salt is generally preferred, e.g. a sodium or potassium sulphide water solution.

Methods of the invention enable selective production of quality metal sulphide conductor coating on dielectric surface without using ammonia hydroxide, amines or other compounds that form strong complex compounds with heavy metals. In addition, methods of the invention produce conductor coatings uses metal ion solution which are highly stable. That is, in distinction from prior systems, bismuth treatment compositions of the invention are highly stable for extended periods. See, for instance, the results set forth in Table 1 below.

The invention also includes articles having a metal plate thereon produced in accordance with the disclosed methods.

Methods and articles of the invention are useful for a wide variety of applications, including for forming electrical circuits and conductors such as present on a printed circuit board or other electronic packaging substrate, a metal finish, and other applications such as producing electromagnetic shielding. The methods of the invention are particularly useful to deposit a decorative or protective nickel plate, or other decorative or protective metal layer.

Other aspects of the invention are disclosed infra.

DETAILED DESCRIPTION OF THE INVENTION

The invention provides new methods for plating dielectric substrates, particularly polymer substrates such as e.g. ABS (acrylonitrile butadiene styrene) copolymer substrates, epoxy resin substrates, polyetherimide substrates, and the like.

The methods of the invention generally include use of a bismuth treatment step. Subsequent treatment with a sulfide material or composition enables quality metallization of the substrate, e.g. with an electrolytic nickel, copper, gold, silver, platinum or other metal plating composition solution. In contrast to other prior systems, plating catalysts such as Pd, or Pd/Sn, platinum or other metal need not be employed to deposit the metal layer. Also, unstable treatment solutions such cobalt need not be employed.

To enhance the metal deposits on the dielectric substrate, preferably the dielectric substrate is first treated with an etchant solution that can provide a chemically and physically modified surface that is optimized for subsequent conditioning and plating. Such materials typically contain a strong oxidant and include the acidic compositions discussed above as well as alkali permanganate compositions.

Treatment compositions employed in accordance with the invention may be applied to a dielectric substrate by a variety of methods, including by spray application as well as immersion. A treatment composition is typically applied as a solution to a substrate.

A variety of bismuth compositions may be employed in accordance with the invention. A trivalent bismuth species is particularly preferred. Both inorganic and organic bismuth materials are suitably employed such as $Bi(NO_3)_3$, $BiCl_2$ or $Bi(CH_3COO)_3$. Those bismuth compositions are preferably present in an acidic aqueous solution, such as a HCl, $HNO_3$ or acetic acid solution. The solution may contain relatively small amount of the bismuth material, e.g. the solution may suitably be from 0.0001 to about 1 molar in bismuth ions, preferably a bismuth ion concentration of about 0.005 to about 0.5 molar, even more preferably a bismuth ion concentration of about 0.005 to about 0.3 molar in an aqueous treatment solution.

The bismuth composition may be applied to a dielectric substrate at room temperature to achieve good results, although the bismuth solution also may be at an elevated temperature.

After treatment with the bismuth composition, the substrate is then treated with a sulfur composition, preferably an aqueous solution that contains a sulfide species, e.g. a sulfur salt such as $Na_2S$ or $K_2S$, or an organic sulfide, such as an alkyl sulfide. $N_2S$ or $K_2S$ is generally preferred.

The sulfide composition also may be applied to a dielectric substrate at room temperature to achieve good results, although a sulfide composition solution also may be at an elevated temperature.

Times of treatment of a dielectric substrate with the above compositions can vary rather widely. In general, treatment times of from 0.25 to 10 minutes are suitable, more typically from 0.5 to about 1, 2, 3, 4 or 5 or more minutes.

Preferably, a treated dielectric substrate is rinsed with water between treatment steps, i.e. after etching, after bismuth treatment and then after sulfur treatment. The substrate may be suitably dried before plating.

A variety of metals may be plated onto a dielectric substrate. Plating compositions are commercially available. For instance, suitable electrolytic copper, nickel and gold plating compositions are available from the Shipley Company (Marlborough, Mass.). A preferred nickel electroplating plating composition and method for use thereof is set forth in the examples below. See also, Coombs, *Printed Circuits Handbook*, ($3^{rd}$ Edition, McGraw Hill), incorporated herein by reference, for additional suitable plating compositions and uses thereof.

Preferred electrolytic copper plating compositions for use in accordance with the invention include an aqueous composition that contains an aqueous solution of $CuSO_45H_2O$ at a concentration of 60 g/l; $H_2SO_4$ at a concentration of 225 g/l; and Cl ions at a concentration of 50 ppm. The treated substrate to be plated is suitably immersed in an air-agitated plating tank outfitted with multiple cathode rails and one rectifier and charged with such a copper plating solution. During plating, the following deposition conditions are suitably employed: current density of 14.5 mA/cm$^2$; DC waveform was DC; and plating bath temperature of 25° C.

References herein to solutions of materials are inclusive of fluid materials where all solid components are dissolved therein, as well as fluid compositions where one or more added components are dispersed or otherwise not fully dissolved in the fluid. Preferably, most or all added components are fully dissolved in the fluid carrier (typically water).

The following non-limiting examples are illustrative of the invention. All documents mentioned herein are incorporated herein by reference.

General Comments to Examples

In the following examples, products made of dielectric-plates made of ABS (a copolymer of vinyl cyanide, divinyl and styrene) plastic substance are etched for 5 minutes at room temperature in solution which contains 13M $H_3PO_4$ and 0.5M $K_2S_2O_8$ or etched for 5 minutes in 60° C. temperature solution which contains 3.8M $H_2SO_4$ and 3.8M $CrO_3$ and rinsed with water.

In the following examples, products of dielectric-shock-resistant polystyrene (SAPS) are etched for 5 minutes in solution containing 17M $H_2SO_4$ and 0.5M $KIO_4$ under room temperature and rinsed with water.

After etching, the products are treated for 2 minutes in solution which contains 0.005/0.300 M $Bi(NO_3)_3$ or $BiCl_3$ or $Bi(CH_3COO)_3$ and 0.01/0.35 M $HNP_3$ or HCl or $CH_3COOH$, under room temperature. After this, products are rinsed with water and for further 30 seconds treated in solution containing 0.01/0.25 M $Na_2S$ or $K_2S$ at room temperature.

When the process is completed, the items are rinsed with distilled water, dried and nickel plated for 15 minutes in Watts electrolyte which contains 1/1.2M $NiSO_4$; 0.15/0.2M $NiCl_2$ and 0.4/0.5M $H_3BO_3$, initial flow density 0.3A/dm$^3$, which, along the progress of nickel coating from the point of contact, increases to 3A/dm$^3$, under electrolyte temperature of 40° C.

Stability of the metal ion solution is assessed, examining the presence of sediment in solution (which means that the solution is unstable) or their absence (which means that the solution is stable).

The smoothness of the conductive sulphide coating is assessed visually immediately after the treatment, in daylight, using two parameters: smooth, not smooth.

Electrical conductivity of the coating is assessed by the chemical nickel-plating expansion speed from the point of contact, in centimeters per minute.

The possibility of selectively producing conductor coating on a dielectric item is assessed by examining whether isolated part of the item is covered in nickel or not.

In the following Examples 1 through 7, Examples 1, 3 and 6 are for control purposes, while Examples 2, 4, 5 and 7 have been prepared in accordance with the proposed method, under different concentrations of bismuth component ions, and using different technological means.

In Examples 3, 4, 5, 6 and 7, subjected to treatment are ABS plastic plates with surface area of 50 cm$^2$, while in Example 2 there are profiled items made of shock-resistant polystyrene (SAPS) with surface area of 70 cm$^2$.

EXAMPLE 1

Profiled articles from shock-resistant polystyrene, with surface area of 70 cm$^2$, etching 5 minutes at room temperature with 17M $H_2SO_4$ and 0.5M $KIO_4$.

Items are rinsed with water after etching and treated for 10 minutes in solution which contains 0.01M $CoF_3$ and 0.35M $NH_4OH$, under room temperature. After this, the items are rinsed in acetic acid up to pH 5 in acid water and treated for 30 seconds in sulphide solution which contains 0.1 M $Na_2S$.

After treatment, the items arc rinsed with distilled water, dried and nickel-plated for 15 minutes in Watts electrolyte, containing (M): $NiSO_4$—1.2; $NiCl_2$—0.2 and $H_3BO_3$—0.5; initial flow density 0.3 A/dm$^2$, temperature 40° C.

EXAMPLE 2

Profiled items made from shock-resistant polystyrene are etched in accordance with the method described in Example 2.

After etching, items are rinsed with water and treated for 2 minutes in a solution containing 0.01M $Bi(No_3)_3$ and 0.03M $HNP_3$ under room temperature. Afterwards, the items arc rinsed in water and treated for 30 seconds in a sulphide solution which contains 0.1M $Na_2S$.

After treatment, the items are rinsed with distilled water, dried and nickel-plated for 15 minutes in Watts' electrolyte, as described in Example 1.

EXAMPLE 3

Plates of ABS plastic with surface area of 50 $cm^2$ are etched for 5 minutes at room temperature solution containing 13M $H_3PO_4$ and 0.5M $K_2S_2O_8$.

After etching, the plates are rinsed with water and treated for 10 minutes in a solution containing 0.25M $CoCl_2$ and 0.7M triethanolamine under room temperature. Following this, the plates are rinsed with water, the alkalinity of which is brought to pH 9.0 by $Na_2CO_3$, and treated for 30 seconds in a sulphide solution which contains 0.01M sodium sulphide under room temperature.

After treatment, the items are rinsed with distilled water, dried and for 15 minutes nickel-plated in Watts' electrolyte, as described in Example 1.

EXAMPLE 4

ABS plastic plates are etched for 5 minutes at room temperature in a solution, containing 13M $H_3PO_4$ and 0.5M $K_2S_2O_8$.

After etching, plates are rinsed with water and treated for 2 minutes in a solution containing 0.3M bismuth acetate and 0.35M acetic acid, at room temperature. After this, plates are rinsed in water and treated for 30 seconds in a sulphide solution which contains 0.01M $Na_2S$, at room temperature.

After treatment, the items are rinsed with distilled water, dried and nickel-plated for 15 minutes in Watts' electrolyte, as described in Example 1.

EXAMPLE 5

ABS plastic plates are etched for 5 minutes in a solution at room temperature, containing 13M $H_3PO_4$ and 0.5M $K_2S_2O_8$.

After etching, plates are rinsed with water and treated for 2 minutes in a solution containing 0.005 $Bi(NO_3)_3$ and 0.01M $HNP_3$ at room temperature. After this, plates are rinsed in water and treated for 30 seconds in a sulphide solution which contains 0.1M $Na_2S$ at room temperature.

After treatment, the items are rinsed with distilled water, dried and nickel-plated for 15 minutes in Watts' electrolyte, as described in Example 1.

EXAMPLE 6

ABS plastic plates are etched for 5 minutes in 60° C. solution, containing 3.8M $H_2SO_4$ and 3.8M $CrO_3$.

After etching, plates are rinsed with water and treated for 10 minutes in a solution, containing 0.01M $CoF_3$ and 0.04M monoethanolamine, at room temperature. After this, plates are rinsed in water, brought to alkalinity of pH 14 by NaOH and treated for 30 seconds in a sulphide solution which contains 0.25M $K_2S$ at room temperature.

After treatment, the items, are rinsed with distilled water, dried and nickel-plated for 15 minutes in Watts' electrolyte, as described in Example 1.

EXAMPLE 7

ABS plastic plates are etched for 5 minutes in 60° C. solution, containing 3.8M $H_2SO_4$ and 3.8M $CrO_3$.

After etching, plates are rinsed with water and treated for 2 minutes in a solution containing 0.01M $BiCl_3$ and 0.03M HCl, at room temperature. After this, plates are rinsed in water and treated for 30 seconds in a sulphide solution which contains 0.25M $K_2S$ at room temperature.

After treatment, the items are rinsed with distilled water, dried and nickel-plated for 15 minutes in Watts' electrolyte, as described in Example 1.

Data about coating qualities are given in Table 1 below. Data shown in Table 1 below indicate that under different dielectric items and different regimes of their etching, the new method of producing coatings is not longer and the quality of the coating is not inferior to that obtained by known methods, while in some cases the quality of the new method coating is indeed superior.

TABLE 1

| Composition of solutions, technological and quality indices of coatings | EXAMPLES 1 (control) | 2 | 3 (control) | 4 | 5 | 6 (control) | 7 |
|---|---|---|---|---|---|---|---|
| Dielectric | | | | | | | |
| Etching solution | $H_2SO_4$ + $H_2O$ + $KIO_4$ | $H_2SO_4$ + $H_2O$ + $KIO_4$ | $H_2SO_4$ + $H_2O$ + $K_2S_2O_8$ | $H_2SO_4$ + $H_2O$ + $K_2S_2O_8$ | $H_2SO_4$ + $H_2O$ + $K_2S_2O_8$ | $H_2SO_4$ + $H_2O$ + $CrO_3$ | $H_2SO_4$ + $H_2O$ + $CrO_3$ |
| Metallic ion solution composition (m) and stability: | $CoF_3$ - 0.01 $NH_4OH$ - 0.12 | $Bi(NO_3)_3$ - 0.01 $HNO_3$ - 0.03 | $CoCl_2$ - 0.3 triethanolamine - 07 | $Bi(CH_3COO)_3$ - 0.3 $CH_3COOH$ -0.35 | $Bi(NO_3)_3$ - 0.005 $HNO_3$ 0.01 | $CoF_3$ -0:01 monoethanol-amine - 0.04 | $BiCl_3$ 0.01 HCl - 0.03 |
| stable (+) or unstable (−) | − | + | − | + | + | − | + |
| Quantity of consecutive treatments in solution | 1 | 1 | 1 | 1 | 1 | 1 | 1 |
| Nickel plating of plastic surface, complete (+) or Incomplete (−) | + | + | + | + | + | + | + |
| Speed of electroplating spread from point of contact, cm/min | 3–4 | 5–7 | 2–3 | 6–8 | 3–4 | 3–4 | 6–8 |

TABLE 1-continued

| Composition of solutions, technological and quality indices of coatings | EXAMPLES 1 (control) | 2 | 3 (control) | 4 | 5 | 6 (control) | 7 |
|---|---|---|---|---|---|---|---|
| Smoothness of coating | Smooth | Smooth | smooth | smooth | smooth | smooth | smooth |
| Dielectric metal-coated selectively (+) or non-selectively (–) | + | + | + | + | + | + | + |

The foregoing description of the invention is merely illustrative thereof, and it is understood that variations and modifications can be effected without departing from the spirit or scope of the invention as set forth in the following claims.

What is claimed is:

1. A process for metal deposition, comprising treating a dielectric with a bismuth material and a sulfur material and metal plating the treated dielectric.

2. The process of claim 1 wherein the dielectric is treated with trivalent bismuth.

3. The process of claim 1 or 2 wherein the dielectric is first treated with the bismuth material and then treated with the sulfur material.

4. The process of claim 3 wherein the dielectric is treated with water after treatment with the bismuth material and before treatment with the sulfur material.

5. The process of claim 1 or 2 wherein the sulfur material is a sulfide reagent.

6. The process of claim 5 wherein the sulfide reagent is an inorganic or organic sulfide.

7. The process of claim 6 wherein the sulfide reagent is a sulfur salt.

8. The process of claim 1 wherein the dielectric is treated with a solution of the bismuth material.

9. The process of claim 8 wherein the bismuth solution is an aqueous solution having a bismuth ion concentration of from about 0.005 to about 0.3M.

10. The process of claim 1 wherein the dielectric is treated with a solution of the sulfur material.

11. The process of claim 10 wherein the sulfur solution is an aqueous sulfide solution.

12. The process of claim 1 wherein the dielectric is metal plated with nickel.

13. The process of claim 1 wherein the dielectric is metal plated with copper.

14. The process of claim 1 wherein the dielectric is metal plated with gold.

15. The process of claim 1 wherein the dielectric is treated with an etchant prior to treatment with the bismuth material.

16. The process of claim 1 wherein the dielectric comprises an epoxy resin, ABS, or a polyetherimide.

17. The process of claim 1 wherein the dielectric is an electronic packaging dielectric.

18. The process of claim 1 wherein the metal plating provides a decorative or protective function.

* * * * *

US006610365C1

(12) EX PARTE REEXAMINATION CERTIFICATE (5757th)

United States Patent

Baranauskas

(10) Number: US 6,610,365 C1

(45) Certificate Issued: May 1, 2007

(54) METHODS OF PRODUCING CONDUCTOR LAYERS ON DIELECTRIC SURFACES

(75) Inventor: Mykolas Baranauskas, Vilnius (LT)

(73) Assignee: Shipley Company, L.L.C., Marlborough, MA (US)

Reexamination Request:
No. 90/007,476, Mar. 25, 2005

Reexamination Certificate for:

| | |
|---|---|
| Patent No.: | **6,610,365** |
| Issued: | **Aug. 26, 2003** |
| Appl. No.: | **09/910,448** |
| Filed: | **Jul. 20, 2001** |

(30) Foreign Application Priority Data

Jul. 20, 2000 (LT) ..... 2000-074

(51) Int. Cl.
*B05D 3/00* (2006.01)

(52) U.S. Cl. ..... 427/306; 427/304; 427/305

(58) Field of Classification Search ..... None
See application file for complete search history.

(56) References Cited

U.S. PATENT DOCUMENTS 5,484,518 A 1/1996 Goldberg

*Primary Examiner*—Stephen Stein

(57) ABSTRACT

A method for producing conductor coating on dielectric surface may be used in many areas of industry for preparation of dielectric surfaces for selective electroplating. Using this method, conductor coatings are obtained when dielectric items are etched in acidic solutions containing oxidising agents, then treated in trivalent bismuth compound solution and additionally treated in sulphide solution.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT PRINTED HEREIN.

Column 3, lines 13–17:

After treatment with the bismuth composition, the substrate is then treated with a sulfur composition, preferably an aqueous solution that contains a sulfide species, e.g. a sulfur salt such as $Na_2S$ or $K_2S$, or an organic sulfide, such as an alkyl sulfide. [$N_2S$] *$Na_2S$* or $K_2S$ is generally preferred.

Column 4, lines 12–18:

When the process is completed, the items are rinsed with distilled water, dried and nickel plated for 15 minutes in Watts electrolyte which contains 1/1.2M $NiSO_4$; 0.15/0.2M $NiCl_2$ and 0.4/0.5M $H_3BO_3$, initial flow density [0.3A/dm$^3$] *0.3A/dm$^2$*, which, along the progress of nickel coating from the point of contact, increases to [3A/dm$^3$] *3A/dm$^2$*, under electrolyte temperature of 40° C.

Column 4, lines 55–59:

EXAMPLE 2

Profiled items made from shock-resistant polystyrene are etched in accordance with the method described in Example [2] *1*.

AS A RESULT OF REEXAMINATION, IT HAS BEEN DETERMINED THAT:

Claims 5–7 are cancelled.

Claim 1 is determined to be patentable as amended.

Claims 2–4 and 8–18, dependent on an amended claim, are determined to be patentable.

New claim 19 is added and determined to be patentable.

1. A process for metal deposition, comprising treating a dielectric with a bismuth material and a sulfur material, *wherein the sulfur material is $Na_2S$, $K_2S$, organic sulfide, or mixtures thereof* and metal plating the treated dielectric.

*19. The process of claim 1, wherein the organic sulfide is an alkyl sulfide.*

* * * * *